US006599198B2

(12) United States Patent
Ettenhofer

(10) Patent No.: US 6,599,198 B2
(45) Date of Patent: Jul. 29, 2003

(54) TRAINING APPARATUS FOR PHYSICAL THERAPY, THERAPEUTIC RIDING IN PARTICULAR

(76) Inventor: Michael Ettenhofer, 3737 E. Northfield Church Rd., Ann Arbor, MI (US) 48105

( * ) Notice: Subject to any disclaimer, the term of this patent is extended or adjusted under 35 U.S.C. 154(b) by 0 days.

(21) Appl. No.: 09/978,996

(22) Filed: Oct. 15, 2001

(65) Prior Publication Data

US 2003/0073504 A1 Apr. 17, 2003

(51) Int. Cl.[7] ..... A63G 13/08
(52) U.S. Cl. ..... 472/104; 472/105; 434/247
(58) Field of Search ..... 472/95, 103, 104, 472/105; 434/247

(56) References Cited

U.S. PATENT DOCUMENTS

| | | | | |
|---|---|---|---|---|
| 2,625,395 A | | 1/1953 | Spangler | 272/52 |
| 2,937,691 A | | 5/1960 | Horgan | 155/50 |
| 2,971,758 A | * | 2/1961 | Zimmers | 472/105 |
| 2,978,245 A | | 4/1961 | Rempel | 272/52 |
| 3,298,702 A | | 1/1967 | Rademacher | 280/1.22 |
| 3,379,438 A | | 4/1968 | Stewart | 272/52 |
| 3,672,075 A | | 6/1972 | Eikelenboom | 35/29 R |
| 4,470,373 A | | 9/1984 | Kesler | 119/15.6 |
| 4,575,072 A | | 3/1986 | Russell | 272/52 |
| 4,957,444 A | | 9/1990 | Armen | 434/247 |
| 5,004,216 A | * | 4/1991 | Boudreau | 267/179 |
| 5,429,515 A | | 7/1995 | Greenwood | 434/247 |
| 6,036,604 A | * | 3/2000 | Klitsner | 297/181 |
| 6,264,569 B1 | * | 7/2001 | Cannavino | 472/95 |

* cited by examiner

*Primary Examiner*—Kien T. Nguyen
(74) *Attorney, Agent, or Firm*—Gifford, Krass, Groh, Sprinkle, Anderson & Citkowski, PC

(57) ABSTRACT

Apparatus to qualify individuals for equine-assisted physical therapy is controlled entirely by a trainer or therapist, thereby regimenting the process for consistent and transferable results. The preferred embodiment includes a rigid frame with a plurality of upright, spaced-apart vertical members, and a rideable body within the frame, preferably suspended from the vertical uprights using multiple springs. At least one handle, rigidly affixed to the rideable body, enables the trainer or therapist to direct the motion of the body with a rider thereon, to determine how the individual will adapt to riding on a living horse, or to train the client with no actual riding experience. The rideable body is horseback shaped, enabling a saddle to be received thereon. The outer surface of the rideable body is also substantially smooth, however, enabling the individual to mount the body in bareback-style, if so desire. The apparatus preferably further includes a structure connecting the vertical members relative to their lower ends, such that the spaces between the vertical members remains open to the ground, enabling the trainer/therapist to stand close to or away from the rider without physical impediment. Attachment points are preferably provided, enabling a plurality of springs or other elastic members to be attached from each vertical member to the body, thereby facilitating adjustment for different riders of varying weight.

23 Claims, 1 Drawing Sheet

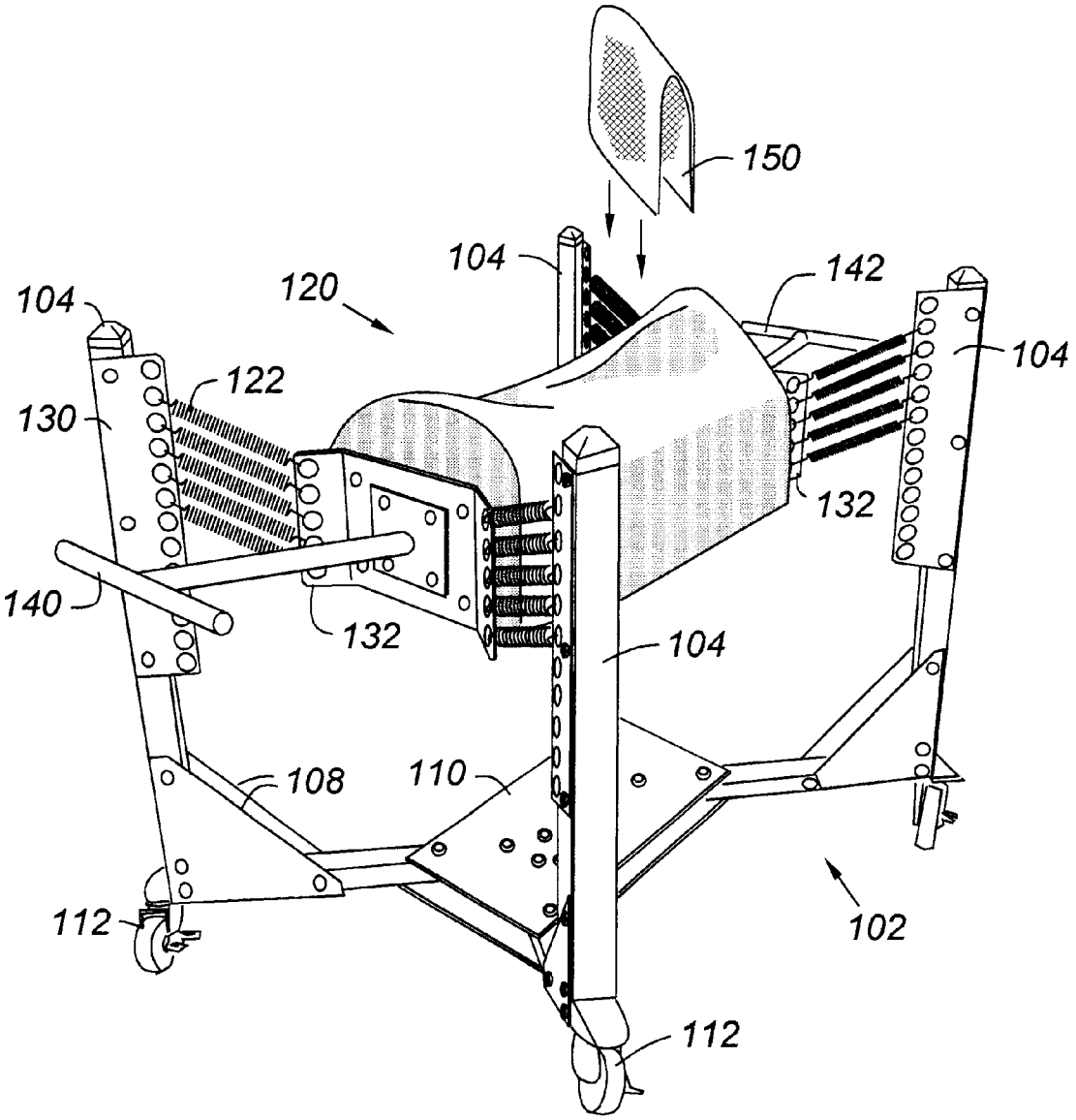
Figure

TRAINING APPARATUS FOR PHYSICAL THERAPY, THERAPEUTIC RIDING IN PARTICULAR

FIELD OF THE INVENTION

This invention relates generally to physical therapy and, in particular, to apparatus and methods for qualifying candidates for equine-assisted therapeutic regimes.

BACKGROUND OF THE INVENTION

Equine activities are now recognized for providing valuable physical and psychological therapeutic benefits. Such activities include hippotherapy (physical therapy on horseback, using the horse as the therapist) and therapeutic riding, which is particularly directed to the disabled and handicapped. Therapeutic riding, also known as equine assisted therapy, equine facilitated therapy, and riding for the disabled, may be used to achieve a variety of therapeutic milestones, including cognitive, physical, emotional, social, educational and behavioral goals. Horseback riding has been found to be particularly beneficial for nonambulatory persons, who have no natural means of locomotion. The action of the horse relaxes and stimulates unused muscles, building muscle tone and improving coordination and balance.

The action of a horse mimics that of human body action, such that when a person rides a horse, they are forced to move their trunk, arms, shoulders, head and the rest of their body to maintain balance. In other words, as the horse moves, the rider's muscles move in synchronization. To maximize the derived benefits, it is not uncommon for physical and occupational therapists to integrate therapeutic exercise techniques with the movement of the horse to stimulate unused or underused muscles.

There does exist in the prior art at least one horse simulator claimed to be particularly useful and effective with handicapped children. U.S. Pat. No. 4,957,444 teaches a device upon which a person can repeatedly practice basic horse riding skills such as mounting and rein handling to stop and turn without the confusion and fatigue of an actual horse. The device is quite complicated, however, including legs, a body, a neck and a head. The horse's neck is pivotally mounted to its body, the latter including a simulated saddle with stirrups to practice mounting. The horse's head includes a bit simulator and reins to practice stopping and turning. Indicators inform the person being taught when stops and turns have been properly executed. Pressure-sensitive switches activate indicators to inform the person being taught when pressure is properly applied to the horse's body, for example when posting.

Although there are less sophisticated horse simulators, including hobbyhorses, and the like, such devices are limited in terms of flexibility. Examples are described in U.S. Pat. Nos. 2,625,395; 2,937,691; 2,978,245; 3,298,702; 3,379,438; and 4,575,072; and no doubt elsewhere in the literature. Of these, U.S. Pat. No. 4,575,072 is specifically directed to a therapeutic riding device for use by a cerebral palsied child to reduce spasticity. The device features a seat, a center hump forwardly of the seat, handle grips and footrests all constructed and positioned in relation to one another to properly position and support a cerebral palsied rider so as to reduce spasticity through a reflex-inhibiting posture, thereby allowing the rider more normal muscle tone in the use and development of his muscles.

However, as such devices are intended primarily for children, they cannot readily accept individuals in excess of 200 pounds, nor can they be adjusted to accommodate trainer-therapists and trainee. Being essentially fixed and lacking in adjustment capability, these prior art "one size fits all" units are not generally applicable to physical therapy or therapeutic riding. Existing devices also do not afford complete trainer/therapist control of the motion of the device, nor do they accept a conventional riding saddle. In addition, due to the way in which their framework is constructed, typically using multiple horizontal side members, they do not allow the trainer/therapist to come in close proximity to the trainee.

SUMMARY OF THE INVENTION

This invention helps to qualify individuals for equine-assisted physical therapy by providing apparatus, controlled entirely by a trainer or therapist, thereby regimenting the process for consistent and transferable results. Broadly, the apparatus includes rigid frame including a plurality of upright, spaced-apart vertical members, and a rideable body suspended within the frame, preferably through the use of multiple springs. At least one handle, rigidly affixed to the rideable body, enables the trainer or therapist to direct the motion of the body with a rider thereon, to determine how the individual will adapt to riding on a living horse, or train a client with no actual riding experience.

In the preferred embodiment, the rideable body is horseback shaped, enabling a saddle to be received thereon. The outer surface of the rideable body is also substantially smooth, however, enabling the individual to mount the body in bareback-style, if so desire. The apparatus preferably further includes a structure connecting the vertical members relative to their lower ends, such that the spaces between the vertical members remains open to the ground, enabling the trainer/therapist to stand close to or away from the rider without physical impediment.

In the preferred embodiment, four vertical members are used to generally define a rectangular volume, and the elastic members suspending the body with in the volume are springs. Attachment points are preferably provided, enabling a plurality of springs or other elastic members to be attached from each vertical member to the body, thereby facilitating adjustment for different riders of varying weight. A plurality of covers may be protectively draped over the springs or other elastic members, and the lower end of each vertical member may optionally be fitted with a locking caster, enabling the apparatus to be moved from place to place and position-stabilized upon arrival.

BRIEF DESCRIPTION OF THE DRAWING

The FIGURE illustrates the preferred embodiment of the invention from an oblique perspective.

DETAILED DESCRIPTION OF THE INVENTION

The FIGURE illustrates the preferred embodiment of the invention from two different perspectives. Accordingly, like numerals will be used throughout to make reference to the same component parts.

Broadly, the apparatus comprises a frame, shown generally at 102, which includes four upright vertical members 104. Note, however, as opposed horizontal members between the uprights, the members 104 are fastened at their lower ends through a general X-shaped structure, thereby leaving room on all four sides of the assembly for trainers and therapists to get as close as possible to the central area of the apparatus without physical obstacles. To add strength, optional braces 108 and plate 110 are included in the design. In addition, to enable the assembly to be portable, optional casters 112 are used, preferably of the locking type, enabling the apparatus to be moved from place to place yet stabilized at a designation for use.

A horseback-shaped body 120 is supported centrally within the vertical upright members through the use of at least one spring such as 122 between the body 120 and each upright. In this preferred embodiment, however, from four (4) to twenty (20) helical tension springs are used to accommodate an individual in excess of 200 pounds. Although springs are used in the preferred embodiment, those of skill in the art will recognize that other elastic members such as rubber, shock cords, and the like, may alternatively be substituted as well as the number of such elements. As a further option, covers 150 are provided over the springs or sets of springs in the event that the rider falls or attempts to grab a hold of the springs to maintain or regain balance, and to contain springs in case of breakage.

The height of the device can also be adjusted to accommodate trainer-therapists and trainee. Toward this end, each vertical upright includes an attached perforated plate, such as 130, and the body includes corresponding perforated members 132, enabling the ends of the springs to engage therewith.

The horseback-shaped body 120 may be constructed of any sufficiently durable material, such as wood, sheet metal, and so forth, though in the preferred embodiment, a mold is made, enabling multiple bodies to be identically reproduced in a material such as fiberglass. The body is preferably generally shaped to correspond to the back of a horse, while having a generally smooth outer surface, enabling a rider to ride the device "bareback," with a saddle blanket, or with a full saddle. The upper surface of the body includes a ridge proximating the neck of the horse (also called the withers), which is received by the bottom of typical saddle arrangements. If stirrups are used, they are adjustable to fit the individual to provide a realistic experience, including mounting and dismounting practice as the body actually moves like a real horse.

The dimensions of the body are also preferably sized to enable the understrap of the saddle to fit around the body and hold the saddle in place, if used. To enable a trainer or therapist to directly control the rideable body, at least one, and preferably two, rigid handles are affixed to the body, as shown. This provides for motion control both front and rear. Different motions are achieved depending if front, rear or both control. "T" handles are preferably used to impart any desired type of motion to the device, including back-and-forth and twisting motions to evaluate and qualify an individual for a particular therapeutic regime.

The device is initially used as a pre-training aid to screen new applicants for their programs. In most cases, the trainer/therapist finds that putting a client on a real horse immediately is too intimidating and may permanently discourage an individual in terms of further training or therapy. Many of the clients have never been higher off the ground than their wheelchair and are understandably intimidated by being seated on real horse. By pre-training on the device, this invention offers a gradual, metered introduction to the motions that will be encountered on a real horse. There may also be instances were the device will be the only riding experience the client will have.

The device may be used by two separate training groups. Therapeutic riding trainers may use it as part of a program intended to help build self-esteem and a sense of accomplishment in individuals with various disabilities. The invention is also applicable to hippotherapy; that is, as part of a physical therapy program where a horse is used to help individuals regain abilities that have been lost due to accident or illness. In such instances, the device is used as a physical therapy (hippotherapeutic) exercise device for closed-head injury or stroke victims, to aid them in reestablishing their balance mechanism and mobility.

I claim:

1. Apparatus for qualifying an individual for equine-assisted physical therapy, comprising:

a rigid frame including a plurality of upright, spaced-apart vertical members defining a volume, each member terminating in a lower end associated with ground contact;

a rideable body suspended by a plurality of elastic members within the volume, each elastic member having one end fastened to the shaped body and an opposing end fastened to a respective one of the vertical members; and at least one handle rigidly affixed to the rideable body and extending to a point outside the volume enabling a trainer or therapist standing outside the volume to direct the motion of the body with a rider thereon.

2. The apparatus of claim 1, wherein the rideable body is horseback shaped, enabling a saddle to be received thereon.

3. The apparatus of claim 2, wherein the surface of the rideable body is substantially smooth, enabling the body to be ridden in bareback style.

4. The apparatus of claim 1, further including a structure connecting the vertical members relative to their lower ends, such that the spaces between the vertical members remain open to the ground.

5. The apparatus of claim 1, wherein the elastic members are springs.

6. The apparatus of claim 1, including attachment points enabling a plurality of elastic members to be attached from each vertical member to the body, thereby facilitating adjustment for different riders of varying weight.

7. The apparatus of claim 1, including four vertical members generally defining a rectangular volume.

8. The apparatus of claim 1, further including a plurality of covers protectively draped over the elastic members.

9. The apparatus of claim 1, further including a locking caster on the lower end of each vertical member, enabling the apparatus to be moved from place to place and position-stabilized upon arrival.

10. The apparatus of claim 1, wherein:

the rideable body has a front portion and a rear portion; and including two handles, one extending from the front portion to a point outside the volume and another one extending from the rear portion to a point outside the volume.

11. Apparatus for qualifying an individual for equine-assisted physical therapy, comprising:

a rigid frame including four spaced-apart vertical members generally defining a rectangular volume, each member terminating in a lower end associated with ground contact;

a rideable body suspended by a plurality of springs within the volume, each spring having one end fastened to a corner of the shaped body and an opposing end fastened to a respective one of the vertical members; the corners of the rideable body and each vertical member including attachment points enabling a plurality of springs to be attached from each vertical member to the body, thereby facilitating adjustment for different riders of varying weighs;

the rideable body being substantially smooth and horseback-shaped, enabling bareback-style riding or a saddle to be received thereon, and at least one handle rigidly affixed to the rideable body and extending outwardly therefrom, the handle enabling a trainer or therapist standing outside the volume to direct the motion of the body with a rider thereon.

12. The apparatus of claim 11, further including a structure connecting the vertical members relative to their lower ends, such that the spaces between the members remains open to the ground.

13. The apparatus of claim 11, further including a locking caster on the lower end of each vertical member, enabling the apparatus to be moved from place to place and position stabilized upon arrival.

14. The apparatus of claim 11, further including a plurality of covers protectively draped over the springs.

15. The apparatus of claim 11, further including a locking caster on the lower end of each vertical member, enabling the apparatus to be moved from place to place and position-stabilized upon arrival.

16. Apparatus for qualifying an individual for equine-assisted physical therapy, comprising:

a rigid frame including a plurality of upright, spaced-apart vertical members defining a volume, each member terminating in a lower end associated with ground contact;

a rideable body suspended within the volume, including a front portion and a rear portion with attachment points enabling a plurality of elastic members to be attached from each vertical member to the body to facilitate adjustment for different riders of varying weight; and two handles rigidly affixed to the rideable body, one extending from the front portion to a point outside the volume and another one extending from the rear portion to a point outside the volume, the handles enabling a trainer or therapist standing outside the volume to direct the motion of the body with a rider thereon.

17. The apparatus of claim 16, wherein the rideable body is horseback shaped, enabling a saddle to be received thereon.

18. The apparatus of claim 17, wherein the surface of the rideable body is substantially smooth, enabling the body to be ridden in bareback style.

19. The apparatus of claim 16, further including a structure connecting the vertical members relative to their lower ends, such that the spaces between the vertical members remains open to the ground.

20. The apparatus of claim 16, wherein the elastic members are springs.

21. The apparatus of claim 16, including four vertical members generally defining a rectangular volume.

22. The apparatus of claim 16, further including a plurality of covers protectively draped over the elastic members.

23. The apparatus of claim 16, further including a locking caster on the lower end of each vertical member, enabling the apparatus to be moved from place to place and position-stabilized upon arrival.

* * * * *